United States Patent [19]

Oses

[11] Patent Number: 4,666,324

[45] Date of Patent: May 19, 1987

[54] STABILIZED UPRIGHT TUBULAR CONTAINER

[75] Inventor: José Osēs, Annecy Le Vieux, France

[73] Assignee: Reboul-SMT, Creteil, France

[21] Appl. No.: 785,675

[22] Filed: Oct. 9, 1985

[30] Foreign Application Priority Data

Oct. 10, 1984 [FR] France ..... 84 15520

[51] Int. Cl.[4] ..... A45D 40/18; A45D 40/00

[52] U.S. Cl. ..... 401/131; 401/68; 401/78; 401/98; 220/69; 446/396

[58] Field of Search ..... 401/131, 98, 78, 75, 401/68; 220/69; 446/396

[56] References Cited

U.S. PATENT DOCUMENTS

| | | | |
|---|---|---|---|
| 3,323,798 | 6/1967 | Miller | 446/396 X |
| 3,805,444 | 4/1974 | Adickes | 446/396 |
| 4,505,607 | 3/1985 | Sugiyama | 401/98 X |

FOREIGN PATENT DOCUMENTS

| | | | |
|---|---|---|---|
| 3139192 | 4/1983 | Fed. Rep. of Germany | 401/68 |
| 515740 | 4/1921 | France | 401/98 |
| 1548336 | 10/1968 | France | 401/75 |
| 2393547 | 2/1979 | France | 401/68 |
| 2115387 | 9/1983 | United Kingdom | 401/131 |

*Primary Examiner*—Steven A. Bratlie

*Attorney, Agent, or Firm*—Finnegan, Henderson, Farabow, Garrett & Dunner

[57] ABSTRACT

A tubular casing which is designed to be stable in an upright position it has a bottom portion with an axial opening into which is forcibly fitted an axial spigot on a base member which engages the bottom portion. An annular ballast weight is fitted around the spigot and is held in place on it by the bottom portion; the ballast weight may have claws on its inside to engage the spigot, which can be of tapering form and has latching members to hold it in the opening.

2 Claims, 2 Drawing Figures

STABILIZED UPRIGHT TUBULAR CONTAINER

Figure 1:
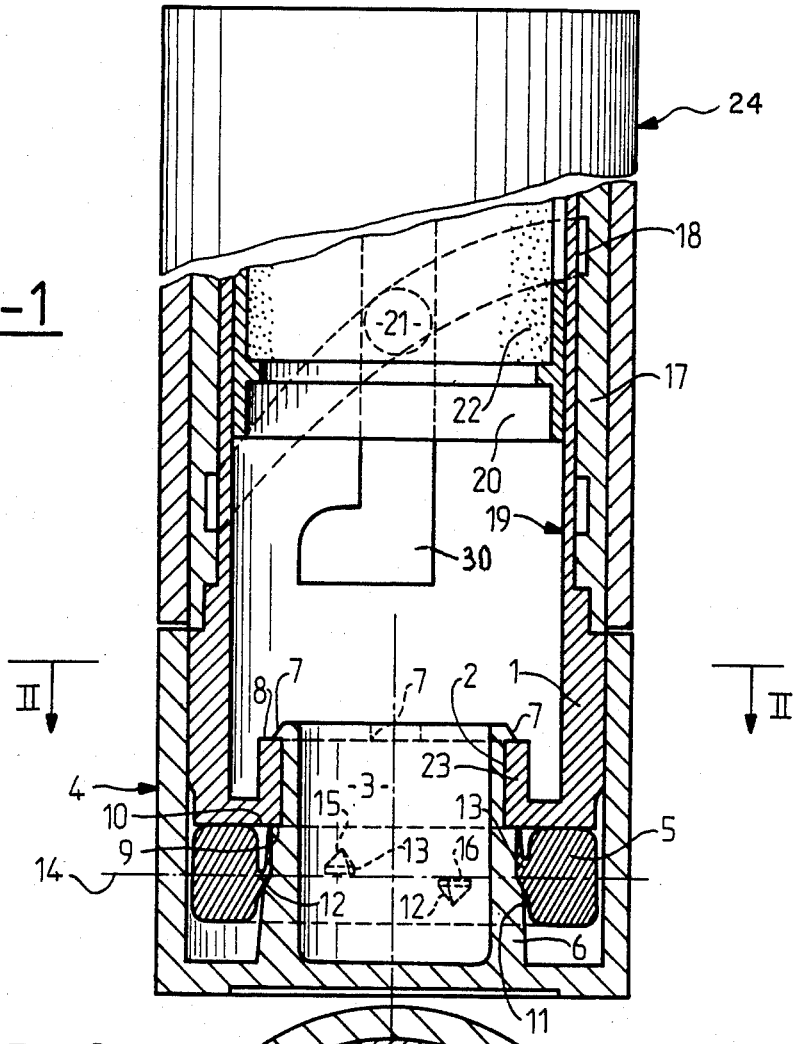

The present invention relates to cylindrical containers designed to stand upright, for example containers for lipsticks and similar cosmetic sticks.

The perennial drawback of this type of package is its lack of stability in an upright position. When the container is placed on its base on a support such as a table it easily falls over and where it is of round cross-section, which is usually the case, it can roll off and fall to the ground It has already been proposed to stabilize such containers by ballasting them with a relatively heavy material such as plaster in the base.

It has also been proposed to put lead shot or a similar substance in the base, or even a simple metal ball.

However these different known kinds of ballast are not convenient for putting into practice and they do not offer themselves to mass production.

The aim of the present invention is to provide a container with a ballasted base which does not have the drawbacks of the known arrangements.

According to the invention there is proposed a tubular container which is stable in an upright position, having a bottom portion with an axial opening into which there is forcibly fitted an axial spigot on a base member engaging the bottom portion, characterised in that it includes a ballast weight of annular form fitted around the spigot, onto which it is held in place by the said bottom portion.

Preferably the lateral external surface of the spigot is of frusto-conical shape with the aim of facilitating the placing of the weight and holding it wedged in place.

To ensure the permanent stability of the container assembly, the spigot could have at that end of it which is inserted into the opening in the bottom portion, at least one radial claw having a snap engagement with the internal rim of the opening, as well as a shoulder engaging the outer rim of the opening.

The ballast weight preferably has on its internal cylindrical face at least one radial claw engaging the external side face of the spigot.

It is of particular advantage for the ballast weight to have a number of claws distributed uniformly around its internal periphery and pointing alternately in opposite axial directions to the one side and the other, respectively, of a diametrical transverse plane of symmetry with the weight.

In this way it is not necessary to orientate the weight in order to fit it onto the spigot, and it is centered automatically.

Each claw could have a triangular shape, coming to a point away from the weight and with its base adjacent the weight.

The invention will now be further described by way of example with reference to the accompanying drawings.

In the drawings

Figure 2:
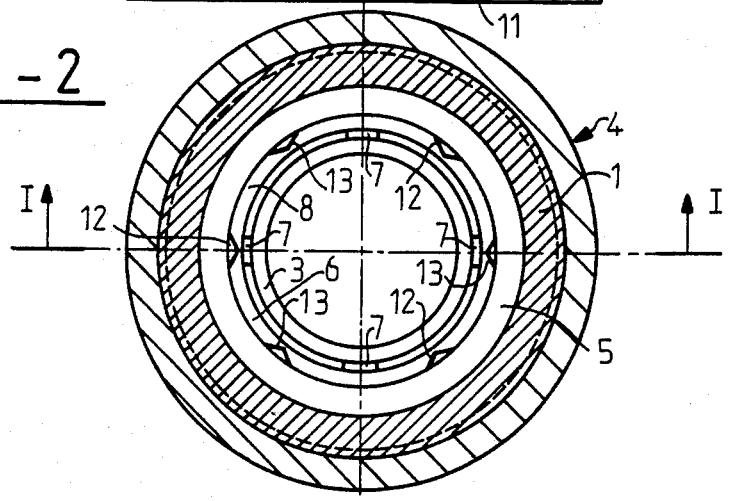

FIG. 1 is a diagrammatic partially sectioned view taken on the line I—I in FIG. 2 showing a lipstick container stabilized in accordance with the invention, and FIG. 2 is a diagrammatic vertical section taken on the line II—II in FIG. 1.

The lipstick container illustrated in the drawings is made in a conventional manner of two concentric sleeves capable of relative rotation, namely an outer sleeeve 17 having a helical groove 18 and an inner sleeve 19 having a longitudinally extending slot 30. Sliding inside the sleeve 19 is a cup or godet 20 which has a lateral projection in the form of at least one peg 21 extending radially through the slot 30 and into the groove 18.

The godet 20 carries a cosmetic stick 22.

With this convventional construction relative rotation of the sleeves 17 and 19 causes the stick 22 to move up or down at will. A removable cap 24 fits over the outer sleeve 17.

The inner sleeve 19 ends in a bottom portion 1 pierced by an axial opening 2 defined by a tubular flange 23, into which is forcibly fitted an axial spigot 3 projecting from the bottom of a base member 4 which fits around the portion 1. This spigot 3 ends in four radial claws 7 which come into snap engagement with the rim around the inner end 8 of the tubular flange 23, whilst a shoulder 9 engages the outer face 10 of the portion 1.

The base member 4 is thus rigidly secured to the inner sleeve 1.

An annular ballast weight 5 is fitted over the spigot 3. The weight has claws 12, 13 projecting radially from its internal face 11. These claws are disposed regularly and symmetrically with respect to a diametral transverse plane of symmetry 14 of the weight 5.

In the example illustrated the weight 5 has six such claws, spaced apart uniformly and pointing alternately in opposite axial directions. The claws 12 visible in the drawings have their bases directed upwards whereas the claw 13 have their bases directed downwards. Each claw has the shape of a triangular pyramid of which the point 15 is directed away from the weight 5 whereas the base 16 of the triangle points is nearest the weight and in practice is situated in the plane of symmetry 14.

During assemmbly of the container the ballast weight 5 is fitted over the head of the spigot 3 without it being necessary to orientate it, then the inner sleeve is forced into place until the claws 7 snap into engagement. As this is done the ballast weight 5 is wedged onto the spigot 3, of which the frusto-conical lower part 6 is engaged by the claws 12–13.

The structure is thus permanently assembled without risk of play and the container is stable when in an upright position. One can easily produce the various components of such a container, for example by moulding the sleeve 1 in polypropylene, the base member 4 in a material which is relatively more resilient such as polystyrene and the ballast weight 5 in a zinc-base alloy or another relatively hard and heavy material.

In such a container according to the invention the ballast weight does not neeed to be struck in place with adhesive, it can be fitted either way up and it becomes jammed on the base by a simple pushing action when the container is assembled.

It can shift neither in rotation nor bodily because of the frusto-conical shape of the spigot. Being always in contact with the bottom portion of the sleeve it cannot, in the event of sudden handling, make the container move by inertia, as could happen for example with a loose ball.

The pyramidal shape of the claws is easy to achieve by moulding or casting. Their remoteness from the outer wall of the weight avoids any risk of detracting from the external appearance of the base member by deformation of it. In practice one can give the claws a projection of the order of 1 to 5 tenths of a millimeter with respect to the play between the diameter of the inside face 11 of the weight 5 and the mean diameter of the frusto-conical lower part 6 of the spigot 3.

The tubular container does not necessarily have to have an external shape which is round in cross-section. It could, for example, have a polygonal external shape in a known manner.

On the other hand it is distinctly preferable for the hole in the bottom portion of the sleeve and for the spigot to be round, so as to avoid the need for any mutual orientation of the different elements during assembly.

I claim:

1. An upright tubular container including a sleeve member having a lower end with an axial opening therein, an annular base member engaging said lower end of said sleeve member, a spigot on said base member, said spigot having an axial tapered exterior surface, and a latching member holding said spigot securely in said lower end of said sleeve member, an annular ballast weight securely fitted around said axial tapered exterior surface of said spigot without deforming an external wall of the annular base member adjacent to said weight.

2. An upright tubular container including a sleeve member having a lower end with an axial opening therein, an annular base member engaging said lower end of said sleeve member, a spigot on said base member, said spigot having an axial tapered exterior surface, and a latching member holding said spigot securely in said lower end of said sleeve member, an annular ballast weight securely fitted around said spigot without deforming an external wall of the annular base member adjacent to said annular ballast weight, said annular ballast weight having internal means for anchoring said annular ballast weight to said tapered exterior surface of said spigot, said internal anchoring means including a plurality of inwardly directed claws circumferentially spaced and directed in opposite axial directions from a transverse plane of symmetry.

* * * * *